US011987864B2

(12) United States Patent
Zhan et al.

(10) Patent No.: US 11,987,864 B2
(45) Date of Patent: May 21, 2024

(54) MAGNESIUM ALLOY AND FORGED COMPONENT

(71) Applicant: GM GLOBAL TECHNOLOGY OPERATIONS LLC, Detroit, MI (US)

(72) Inventors: Henry Zhan, Shanghai (CN); Congjie Wang, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 174 days.

(21) Appl. No.: 17/577,199

(22) Filed: Jan. 17, 2022

(65) Prior Publication Data

US 2022/0251689 A1 Aug. 11, 2022

(30) Foreign Application Priority Data

Feb. 8, 2021 (CN) ..... 202110171202.2

(51) Int. Cl.
*C22C 23/02* (2006.01)

(52) U.S. Cl.
CPC ..... *C22C 23/02* (2013.01)

(58) Field of Classification Search
CPC ..... C22C 23/00; C22C 23/02; C22F 1/06
See application file for complete search history.

(56) References Cited

U.S. PATENT DOCUMENTS 7,967,928 B2 6/2011 Luo et al.
8,357,250 B2 1/2013 Krajewski et al.
2005/0194072 A1 9/2005 Luo et al.
2008/0138236 A1 6/2008 Bae et al.
2010/0096046 A1 4/2010 Krajewski et al.
2014/0332121 A1 11/2014 Park et al.
2017/0283915 A1* 10/2017 Oishi ..... B22D 11/06
2021/0172035 A1 6/2021 Zhan

FOREIGN PATENT DOCUMENTS

CN 101137762 A 3/2008
CN 105603281 A 5/2016
CN 108193110 A 6/2018
(Continued)

OTHER PUBLICATIONS

First Office Action for Chinese Patent Application No. 202110171202.2 dated Mar. 9, 2023, with correspondence from China Patent Agent (H.K.) Ltd. summarizing Office Action; 11 pages.

*Primary Examiner* — Jessee R Roe
(74) *Attorney, Agent, or Firm* — Harness, Dickey & Pierce, P.L.C.

(57) ABSTRACT

A magnesium alloy matrix having an alloy composition including aluminum at a concentration of between 0.5 wt. % to 2.5 wt. %, manganese at a concentration of between 0.3 wt. % to 1.0 wt. %, the concentration of manganese is greater than or equal to a value of [Mn] determined by a linear function [Mn]=x[Al], where x is at least 0.6 when [Al]=0.5 and is at least 0.14 when [Al]=2.5, zinc at a concentration of between 0 wt. % to 3 wt. %, tin at a concentration of between 0 wt. % to 3 wt. %, calcium at a concentration of between 0 wt. % to 0.5%, rare earth metals at a concentration of between 0 wt. % to 5 wt. %, and a balance of the alloy composition being magnesium.

10 Claims, 12 Drawing Sheets

(56) References Cited

FOREIGN PATENT DOCUMENTS

| | | | |
|---|---|---|---|
| CN | 109923230 | A | 6/2019 |
| CN | 111519074 | A | 8/2020 |
| CN | 111527220 | A | 8/2020 |
| CN | 114908278 | A | 8/2022 |
| DE | 102021129463 | A1 | 8/2022 |
| WO | WO-2015126054 | A1 | 8/2015 |

* cited by examiner

360$^0$C

400$^0$C

450$^0$C

MAGNESIUM ALLOY AND FORGED COMPONENT

CROSS-REFERENCE TO RELATED APPLICATIONS

This application claims the benefit and priority of Chinese Patent Application No. 202110171202.2, filed Feb. 8, 2021. The entire disclosure of the above application is incorporated herein by reference.

INTRODUCTION

The present disclosure relates to methods of making magnesium-based alloy compositions that may improve formability of a magnesium cast billet.

Lightweight metal components have become an important focus for manufacturing vehicles, especially automobiles, where continual improvement in performance and fuel efficiency is desirable. While conventional steel and other metal alloys provide various performance benefits, including high strength, such materials can be heavy. Lightweight metal components for automotive applications are often made of aluminum and/or magnesium alloys. Such lightweight metals can form load-bearing components that are strong and stiff, while having good strength and ductility (e.g., elongation). High strength and ductility are particularly important for safety requirements and durability in vehicles like automobiles.

While magnesium alloys are an example of lightweight metals that can be used to form structural components in a vehicle, in practice, the use of magnesium alloys may be limited. While magnesium alloys can be treated by a variety of different formation techniques like wrought processes such as extrusion, rolling, forging, flow forming, stamping, and the like, magnesium alloys are typically limited to processes that only experience low strain rates (e.g., less than 1/second) or else they may crack.

Magnesium has a hexagonal close packed crystal structure and low stacking fault energies. Because of the hexagonal close packed crystal structure, the activation of basal slip is more likely than non-basal slip in deformations, and formability may be low as a result.

The formability of a magnesium alloy slab/billet in an as-cast state with coarse microstructure and casting defects may pose even greater challenges. For example, a common practice of forging commercial Mg—Al alloys (e.g., AZ61 and AZ80) requires that the magnesium cast billet/slab be extruded prior to forging. If extrusion does not take place, the magnesium cast billet/slab is likely to crack during forging and produce an unsatisfactory yield rate. Since pre-extrusion on magnesium cast billet/slabs is time intensive and potentially costly, it would be desirable to be able to form components for vehicles formed of materials comprising magnesium via more streamlined operations, for example, hot deformations on cast billet/slab directly. Thus, there is an ongoing need for improved formation processes to form improved lightweight metal components from cast magnesium-based alloy billet/slabs.

SUMMARY

This section provides a general summary of the disclosure, and is not a comprehensive disclosure of its full scope or all of its features.

In various aspects, the present technology provides a magnesium alloy matrix including aluminum (Al) at a concentration of greater than or equal to about 0.5 wt. % to less than or equal to about 2.5 wt. %, manganese (Mn) at a concentration of greater than or equal to about 0.3 wt. % to less than or equal to about 1.0 wt. %, the concentration of manganese is greater than or equal to a value of [Mn] determined by a linear function [Mn]=x[Al], where x has a value such that x is at least 0.6 when [Al]=0.5 and is at least 0.14 when [Al]=2.5, zinc (Zn) at a concentration of greater than or equal to about 0 wt. % to less than or equal to about 3 wt. %, tin (Sn) at a concentration of greater than or equal to about 0 wt. % to less than or equal to about 3 wt. %, calcium (Ca) at a concentration of greater than or equal to about 0 wt. % to less than or equal to about 0.5%, rare earth metals at a concentration of greater than or equal to about 0 wt. % to less than or equal to about 5 wt. %, the rare earth metals being one or more of an element of the lanthanide series, scandium (Sc), Yttrium (Y), or a combination thereof, and a balance of the alloy composition being magnesium (Mg).

In one aspect, the aluminum (Al) is at a concentration of greater than or equal to about 1.5 wt. % to less than or equal to about 2.5 wt. %, and the manganese (Mn) is at a concentration of greater than or equal to about 0.35 wt. % to less than or equal to about 0.6 wt. %.

In one aspect, the aluminum (Al) is at a concentration of greater than or equal to about 1.5 wt. % to less than or equal to about 2.5 wt. %, and the manganese (Mn) is at a concentration of greater than or equal to about 0.4 wt. % to less than or equal to about 0.6 wt. %.

In one aspect, the aluminum (Al) is at a concentration of greater than or equal to about 1.75 wt. % to less than or equal to about 2.25 wt. %, and the manganese (Mn) is at a concentration of greater than or equal to about 0.45 wt. % to less than or equal to about 0.55 wt. %.

In one aspect, the zinc (Zn) is at a concentration of greater than or equal to about 0 wt. % to less than or equal to about 1.5 wt. %.

In one aspect, the calcium (Ca) is at a concentration of greater than or equal to about 0 wt. % to less than or equal to about 0.2%.

In one aspect, the alloy composition includes at least 0.01 wt. % of the zinc (Zn).

In one aspect, the alloy composition includes at least 0.01 wt. % of the tin (Sn).

In one aspect, the alloy composition includes at least 0.01 wt. % of the calcium (Ca).

In one aspect, the alloy composition includes at least 0.01 wt. % of the rare earth metals.

In various aspects, the present technology provides a forged magnesium component including an alloy matrix including, aluminum (Al) at a concentration of greater than or equal to about 0.5 wt. % to less than or equal to about 2.5 wt. %, manganese (Mn) at a concentration of greater than or equal to about 0.3 wt. % to less than or equal to about 1.0 wt. %, the concentration of manganese is greater than or equal to a value of [Mn] determined by a linear function [Mn]=x[Al], where x has a value such that x is at least 0.6 when [Al]=0.5 and is at least 0.14 when [Al]=2.5, zinc (Zn) at a concentration of greater than or equal to about 0 wt. % to less than or equal to about 3 wt. %, tin (Sn) at a concentration of greater than or equal to about 0 wt. % to less than or equal to about 3 wt. %, calcium (Ca) at a concentration of greater than or equal to about 0 wt. % to less than or equal to about 0.5%, rare earth metals at a concentration of greater than or equal to about 0 wt. % to less than or equal to about 5 wt. %, the rare earth metals being one or more of an element of the lanthanide series, scandium (Sc), Yttrium (Y), or a combination thereof, and a balance of the alloy composition being magnesium (Mg). The alloy matrix has a microstructure including partially dynamically recrystallized grains, an average grain size of the dynamically recrystallized grains being less than or equal to 10 μm. Further, Al—Mn dispersoids are dispersed in the microstructure.

In one aspect, the aluminum (Al) is at a concentration of greater than or equal to about 1.5 wt. % to less than or equal to about 2.5 wt. %, and the manganese (Mn) is at a concentration of greater than or equal to about 0.3 wt. % to less than or equal to about 0.6 wt. %.

In one aspect, the aluminum (Al) is at a concentration of greater than or equal to about 1.5 wt. % to less than or equal to about 2.5 wt. %, and the manganese (Mn) is at a concentration of greater than or equal to about 0.4 wt. % to less than or equal to about 0.6 wt. %.

In one aspect, the aluminum (Al) is at a concentration of greater than or equal to about 1.75 wt. % to less than or equal to about 2.25 wt. %, and the manganese (Mn) is at a concentration of greater than or equal to about 0.45 wt. % to less than or equal to about 0.55 wt. %.

In one aspect, the zinc (Zn) is at a concentration of greater than or equal to about 0 wt. % to less than or equal to about 1.5 wt. %

In one aspect, the zinc (Zn) is at a concentration of greater than or equal to about 0.5 wt. % to less than or equal to about 1.0 wt. %, and the calcium (Ca) is at a concentration of greater than or equal to about 0 wt. % to less than or equal to about 0.2%.

In one aspect, the alloy composition includes at least 0.01 wt. % of at least one of the group consisting of the zinc (Zn), tin (Sn), calcium (Ca), and rare earth metals, or a combination thereof.

In various aspects, the present technology provides a forged magnesium component including an alloy matrix including a concentration of Al [Al], a concentration of manganese greater than or equal to a value of [Mn] determined by a linear function [Mn]=x[Al], where x has a value such that x is at least 0.6 when [Al]=0.5 and is at least 0.14 when [Al]=2.5, Al—Mn dispersoids including $Al_8Mn_5$ dispersoids and Beta-Mn (Al) dispersoids, the Al—Mn dispersoids having an average diameter of greater than about 1 nm and less than about 100 nm. The alloy matrix has a microstructure including partially dynamically recrystallized grains.

In one aspect, the alloy composition includes aluminum (Al) at a concentration of greater than or equal to about 0.5 wt. % to less than or equal to about 2.5 wt. %, manganese (Mn) at a concentration of greater than or equal to about 0.3 wt. % to less than or equal to about 1.0 wt. %, zinc (Zn) at a concentration of greater than or equal to about 0 wt. % to less than or equal to about 3 wt. %, tin (Sn) at a concentration of greater than or equal to about 0 wt. % to less than or equal to about 3 wt. %, calcium (Ca) at a concentration of greater than or equal to about 0 wt. % to less than or equal to about 0.5%, rare earth metals at a concentration of greater than or equal to about 0 wt. % to less than or equal to about 5 wt. %, the rare earth metals being one or more of an element of the lanthanide series, scandium (Sc), Yttrium (Y), or a combination thereof, and a balance of the alloy composition being magnesium (Mg).

In one aspect, the alloy composition includes at least 0.01 wt. % of at least one of the group consisting of the zinc (Zn), tin (Sn), calcium (Ca), and rare earth metals, or a combination thereof.

In one aspect, the Al—Mn dispersoids having an average diameter of less than about 100 nm.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

FIG. 4A illustrates a contour map of the mole fractions of $Al_8Mn_5$ intermetallics formed in the as-cast microstructure with varied Al and Mn contents according to some example embodiments. FIG. 4B illustrates a contour map of the mole fractions of Beta-Mn (Al) solid solution formed in the as-cast microstructure with varied Al and Mn contents according to some example embodiments. FIG. 4C illustrates a contour map of the mole fractions of $Al_8Mn_5$ intermetallics and Beta-Mn (Al) solid solution combined formed in the as-cast microstructure with varied Al and Mn contents according to some example embodiments.

Corresponding reference numerals indicate corresponding parts throughout the several views of the drawings.

DETAILED DESCRIPTION

Figure 1:
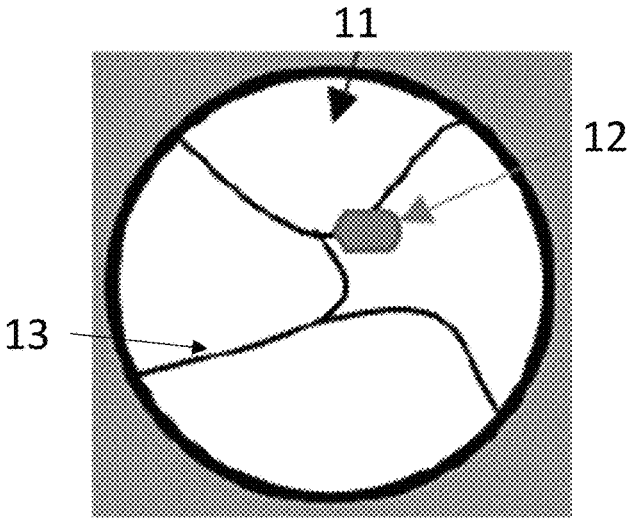
FIG. 1 illustrates a microstructure of magnesium alloy after casting prior to further treatment according to some example embodiments.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

As discussed above, there are certain disadvantages associated with magnesium alloys. Accordingly, the current technology provides magnesium alloys that are configured to be forged and/or stamped into a component having a predetermined shape that may not have been extruded prior to forging/stamping or other hot deformation processes. In various aspects, the magnesium alloys may have low aluminum solute in solid solution and include aluminum-manganese dispersoids, which may improve formability.

The magnesium alloys formed in accordance with certain aspects of the present disclosure are particularly suitable for use to form components of an automobile or other vehicles (e.g., motorcycles, boats, tractors, buses, motorcycles, mobile homes, campers, and tanks), but they may also be used in a variety of other industries and applications, including aerospace components, consumer goods, devices, buildings (e.g., houses, offices, sheds, warehouses), office equipment and furniture, and industrial equipment machinery, agricultural or farm equipment, or heavy machinery, by way of non-limiting example. Non-limiting examples of automotive components include hoods, pillars (e.g., A-pillars, hinge pillars, B-pillars, C-pillars, and the like), panels, including structural panels, door panels, and door components, interior floors, floor pans, roofs, exterior surfaces, underbody shields, wheels, control arms and other suspension, crush cans, bumpers, structural rails and frames, cross car beams, undercarriage or drive train components, and the like.

In certain aspects, the present disclosure pertains to methods of making magnesium alloys that may contain low aluminum solute in solid solution and a high volume of aluminum-manganese precipitates or dispersoids. The methods provided herein enable the formation of components comprising magnesium alloys by hot deformation on magnesium alloy cast billet/slabs that may contain low aluminum solute in solid solution and aluminum-manganese dispersoids, which is beneficial for formability and mechanical properties of the formed magnesium alloy components. Generally, magnesium alloys display anisotropic behavior and have insufficient deformation mechanisms during deformation and working, which can limit the options available for processing. The anisotropic deformation behavior can occur at least in part during forming of the desired shape of the articles by deformation processing. Due to strong geometrical softening effects in magnesium alloys, strain localization tends to occur, which can lead to severe cracking at early formation stages. Extrusion prior to hot deformations can help refine microstructures and casting defects in magnesium cast billet/slabs and therefore improve formability. Thus, magnesium alloy cast billet/slabs that do not undergo extrusion prior to hot deformations generally cannot be formed without cracking in manufacturing processes.

Strong anisotropic deformation behavior of commercial magnesium alloys, such as AZ61 and AZ80, may be due to high aluminum content. A relatively high aluminum content added to these commercial magnesium alloys may produce excellent castability and strong solid solution strengthening effect. However, the aluminum solute adversely affects the cross-slip capability of pyramidal slip in magnesium, and thereby enhances anisotropic deformation behavior of magnesium alloy, which is unfavorable for formability in deformation processing.

Commercial magnesium alloys of low/zero aluminum content, such as AZ31, may have better formability. However, the strength properties of these magnesium-based alloys cannot satisfy requirement of critical load-bearing components.

Strength properties are typically reduced with reducing aluminum concentration. To increase strength properties of a magnesium based alloy with low aluminum content, alternative strengthening mechanisms may include precipitation strengthening and/or grain boundary strengthening. Strong precipitation strengthening in magnesium may be related to premium elements such as Zr, Gd, Nd, In, Ag and/or very high concentrations of Al and Zn, which may be undesirable for other reasons. In contrast, grain refinement, which facilitates grain boundary strengthening, can be accomplished by enabling the precipitation of a dispersoid. Dispersoids are thermally stable particles of refined size which may precipitate out in homogenization treatment at a relatively high temperature. Dispersoids may exert pinning force on grain boundaries of dynamic recrystallized grains to retard undesirable grain growth, contributing to grain refinement strengthening effect.

Spherical dispersoids, for example, Al—Mn dispersoids, may also promote the activation of non-basal slips by reducing the ratio between the critical resolved shear stresses of basal and non-basal slips, contributing to reduced anisotropic deformation behavior and better formability;

In accordance with certain aspects of the present disclosure, certain magnesium alloys that may have low aluminum content and contain aluminum-manganese dispersoids may form an advantageous microstructure in a magnesium cast billet/slab that can subsequently be subjected to hot deformation without suffering from significant cracking. Suitable magnesium alloys may have a composition comprising magnesium at a concentration of greater than or equal to about 85 wt. %, manganese (Mn) at a concentration of greater than or equal to about 0.3 wt. % to less than or equal to about 1.0 wt. %, aluminum (Al) at a concentration of greater than or equal to about 0.5 wt. % to less than or equal to about 2.5 wt. %, zinc (Zn) at a concentration of greater than or equal to about 0 wt. % to less than or equal to about 3.0 wt. %, tin (Sn) at a concentration of greater than or equal to about 0 wt. % to less than or equal to about 3.0 wt. %, calcium (Ca) at a concentration of greater than or equal to about 0 wt. % to less than or equal to about 0.5 wt. %, rare earth metals at a concentration of greater than or equal to about 0 wt. % to less than or equal to about 5.0 wt. %. The rare earth metals may be one or more of the elements of the lanthanide series, and/or Yttrium (Y). Weight percent (wt. %) or mass percent, is the weight of a component divided by the weight of the overall alloy composition multiplied by 100. For example, 3 pounds of aluminum in a 100-pound sample of magnesium alloy would have a weight percent of 3. As discussed further below, an element having a minimum concentration of greater than or equal to 0 wt. % may either be not present, or, alternatively have a minimum concentration of 0.01%.

With reference to FIG. 1, during casting of the magnesium alloy, as the magnesium alloy solidifies, the magnesium may solidify in a dendrite formation. The magnesium alloy may also develop distinct grains with grain boundaries 13. Mn may be supersaturated in the Mg dendrites during solidification and form Mn containing intermetallics 12. The Mg matrix 11 may then precipitate Mn out of the Mg matrix 11 in the subsequent heat treatment due to the super-saturation of Mn in the Mg matrix 11.

The Mn containing intermetallics 12 may be micrometer scale $Al_8Mn_5$, or the Beta-Mn (Al) phase present in the solidification of the magnesium alloy, or other Mn containing phases. The Mn containing intermetallics 12 may be detrimental to the ductility and formability of the magnesium alloy. As such, limiting the formation of the Mn containing intermetallics 12 would be beneficial.

Figure 2:
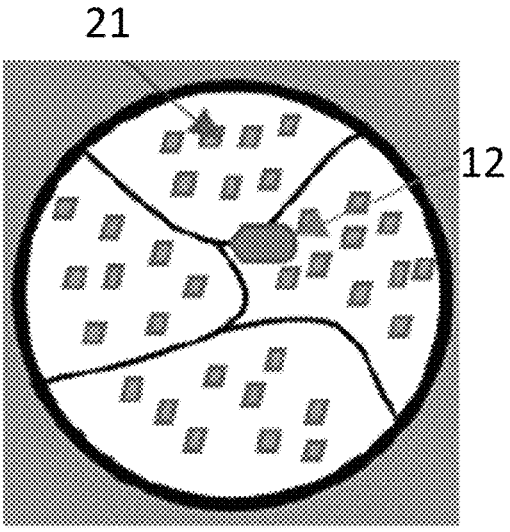
FIG. 2 illustrates a microstructure of magnesium alloy after a heat treatment according to some example embodiments.

With reference to FIG. 2, during homogenization of the cast magnesium alloy, a plurality of Al—Mn dispersoids 21 may form. The Al—Mn dispersoids 21 may promote activation of non-basal slip by reducing a ratio between the critical resolved shear stresses of the basal and non-basal slips, and thereby contribute to reduced anisotropic deformation behavior leading to improved formability.

Figure 3:
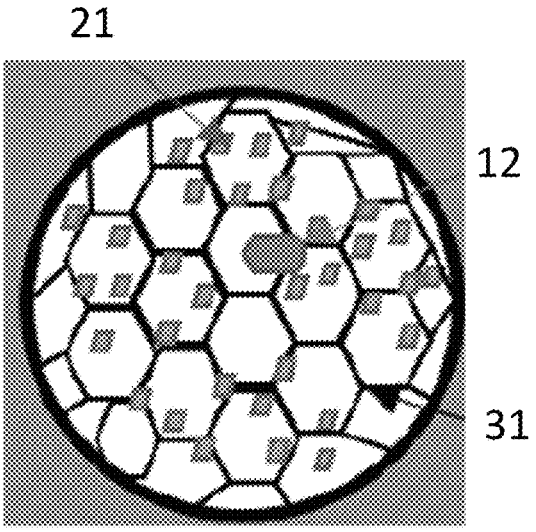
FIG. 3 illustrates a microstructure of magnesium alloy after forging according to some example embodiments.

With reference to FIG. 3, in some example embodiments, after a forging operation, the magnesium alloy may undergo dynamic recrystallization. Dynamic recrystallization (DRX) is the nucleation and growth of new grains that occurs during deformation, and usually at elevated temperatures. The new grains 31, or, alternatively, recrystallized grains 31, may have different grain sizes and orientations than were previously present in the metal piece, as such the new grains may alter the mechanical properties in negative and/or positive ways. Larger grains from dynamic recrystallization may in particular, be undesirable for mechanical strength. The smaller size and larger volume fraction of Al—Mn dispersoid is beneficial for promoting a fine microstructure after forming, which contributes to a higher strength.

Figure 4A:
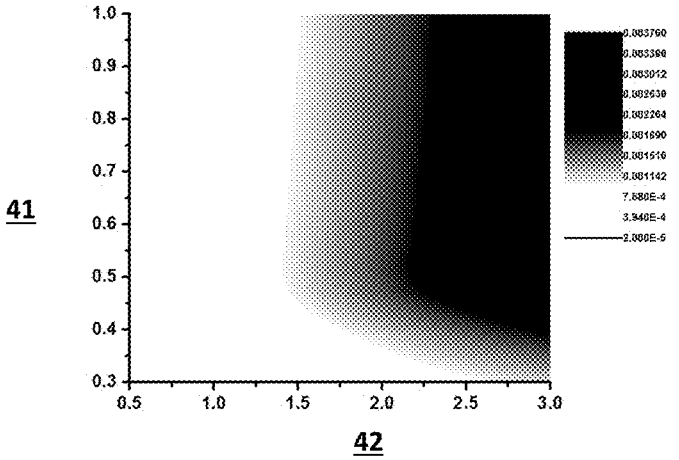
FIGS. 4A-4C.
Figure 4B:
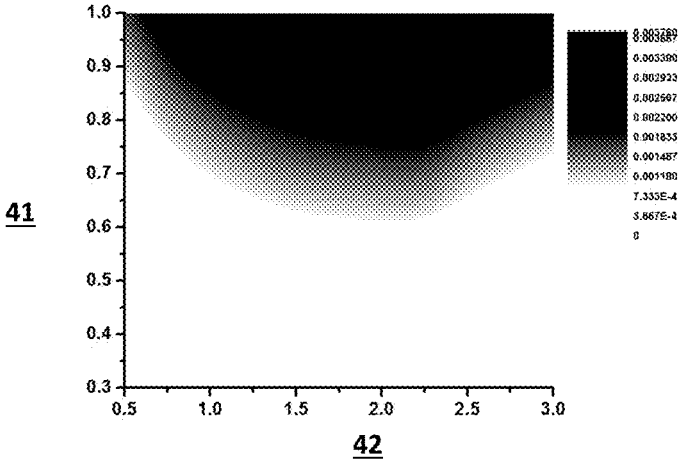
Figure 4C:
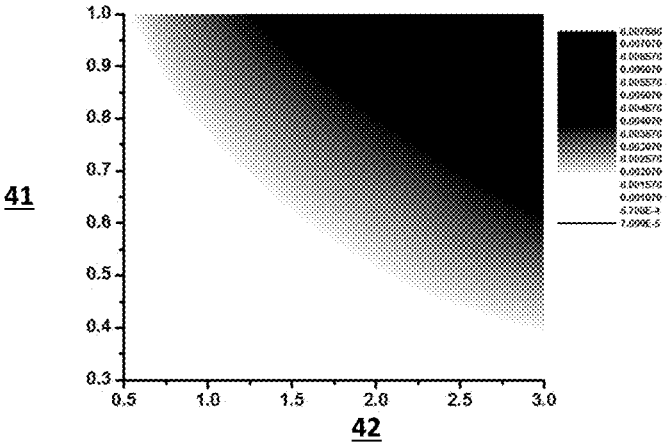

Scheil solidification calculations predict that the dominant Mn-containing phases in the as-cast microstructure of Mg—Al—Mn alloys may be the $Al_8Mn_5$ phase and the Beta-Mn (Al) solid solution. Contour maps in FIGS. 4A and 4B show the mole fractions of $Al_8Mn_5$ and Beta-Mn (Al) solid solution formed in the as-cast microstructure with varied Al wt. % (y-axis 41) and Mn wt. % (x-axis 42) contents, respectively (all compositions quoted afterwards are in weight percent unless otherwise stated). FIG. 4C shows that the total mole fraction of $Al_8Mn_5$ and Beta-Mn (Al) phases after casting increases with increasing 41 Al wt. % and 42 Mn wt. % contents. The most frequently used composition range for AZ31B is framed in FIG. 4C, revealing that the total fraction of Mn-bearing phases in the as-cast AZ31B is predicted to be less than 0.3 mol. %.

The mole fraction of Mn-containing dispersoid formed during homogenization treatment, $M_{disp}$, can be calculated by:

$$M_{disp.}=(M_{equil}-M_{Scheil})$$

in which $M_{equil}$ and $M_{Scheil}$ are the mole fraction of Al—Mn phases at a given homogenization temperature with the equilibrium state reached and the mole fraction of Al—Mn phases formed in Scheil solidification (simulated as-cast state), respectively. Subtracting the fraction of Al—Mn phases formed in casting from the total fraction of Al—Mn phases at a given homogenization temperature yields the fraction of Al—Mn phase newly formed in the homogenization treatment. This value was approximated as the fraction of Al—Mn dispersoid that can be precipitated out during homogenization treatment and can be used to guide alloy design.

Figure 5:
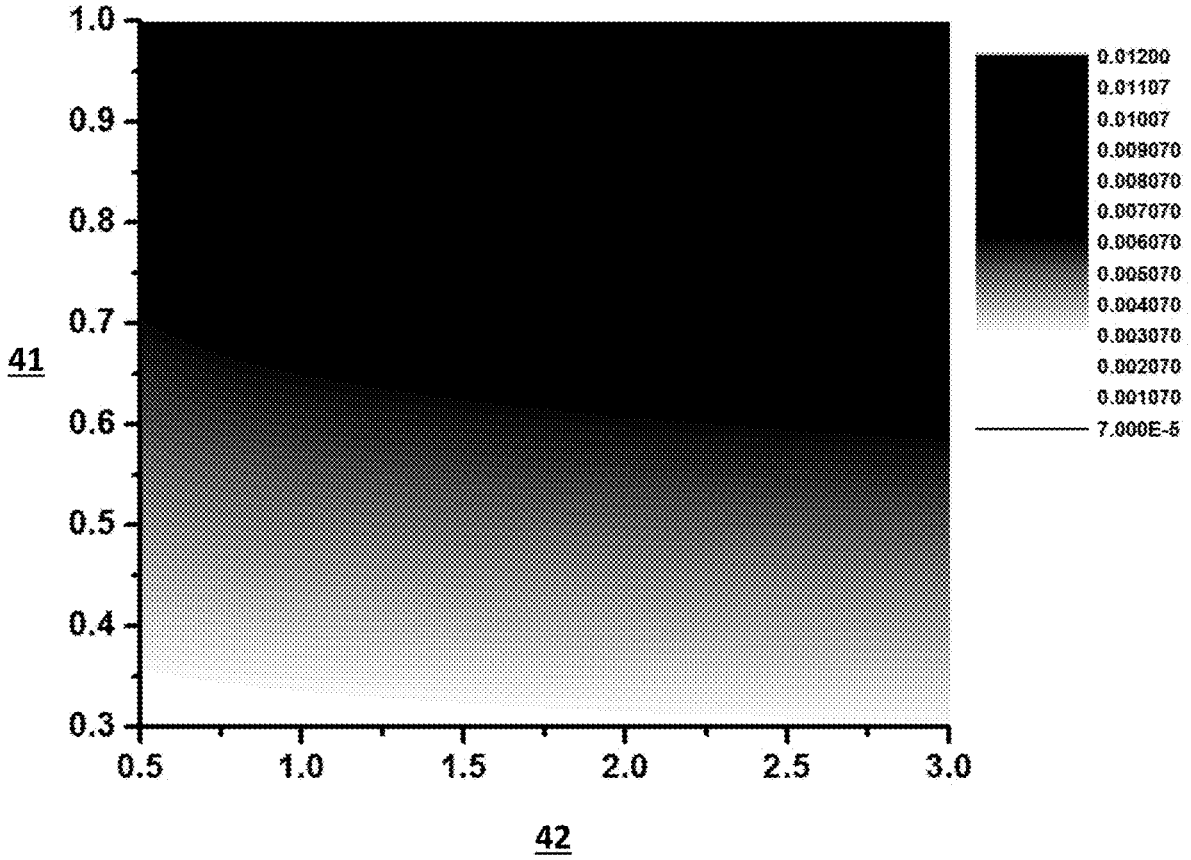
FIG. 5 illustrates a contour map of the total mole fraction of $Al_8Mn_5$ in an equilibrium state at 400° C. with varied Al and Mn contents according to some example embodiments.
Figure 6:
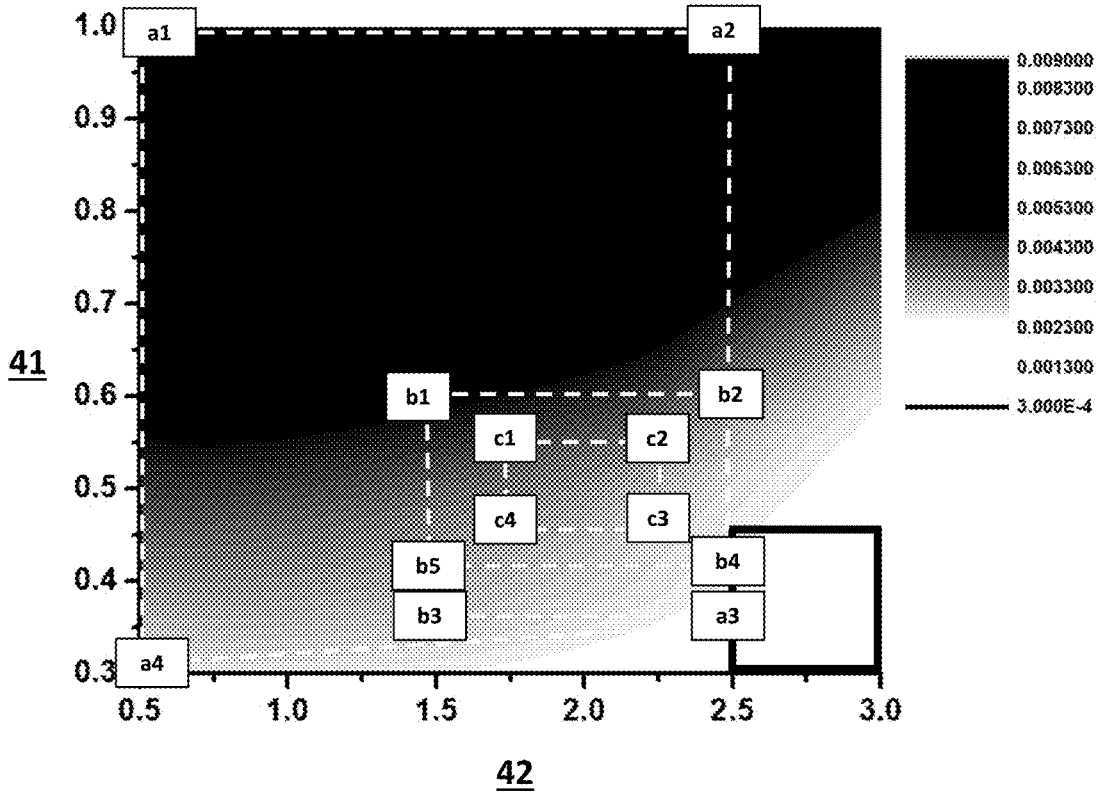
FIG. 6 illustrates composition coordinates of the magnesium alloy overlaid on a contour map of the mole fraction of $Al_8Mn_5$ dispersoid formed at 400° C. in an equilibrium state, according to some example embodiments.

For example, by thermodynamic calculations, it is found that $Al_8Mn_5$ is the only Mn-bearing phase in the equilibrium state in the homogenization temperature range, 400-420° C., applied for Mg—Al series alloys in the industry. The contour map for the total mole fraction of $Al_8Mn_5$ in the equilibrium state at 400° C. with varied Al and Mn contents is plotted in FIG. 5. Subtracting the fraction of $Al_8Mn_5$ phase formed in the as-cast microstructure from this total fraction yields the fraction of $Al_8Mn_5$ phase newly formed at 400° C. By the aforementioned approach, the fraction of $Al_8Mn_5$ dispersoid formed in the homogenization treatment at 400° C. has been predicted as shown in FIG. 6. In general, the fraction of Al—Mn dispersoid increases with increasing manganese content and decreasing aluminum content.

As shown in FIG. 6, the composition of the alloy of some example embodiments may have the following coordinate points in the Al—Mn diagram: a1-a2-a3-a4-a1 (where a1=0.50 wt % Al, 1.00 wt % Mn, a2=2.50 wt % Al, 1.00 wt % Mn, a3=2.50 wt % Al, 0.35 wt % Mn, and a4=0.50 wt % Al, 0.30 wt % Mn). In some example embodiments including this composition range, the mole fraction of Al—Mn dispersoid formed in homogenization treatment at 400° C. may be higher than the maximum value that can be achieved in traditional AZ31 alloy (0.0023).

In some example embodiments, to avoid the generation of high volume of coarse Mn-containing intermetallics which is detrimental to ductility in casting, a second composition range may have the following coordinate points in the Al—Mn diagram in FIG. 6: b1-b2-a3-b3-b1 (where b1=1.50 wt % Al, 0.60 wt % Mn, b2=2.50 wt % Al, 0.60 wt % Mn, a3=2.50 wt % Al, 0.35 wt % Mn, and b3=1.50 wt % Al 0.35 wt % Mn).

In some example embodiments, to generate a higher volume of Al—Mn dispersoid, a third composition range may have the following coordinate points in the Al—Mn diagram in FIG. 6: b1-b2-b4-b5-b1 (where b1=1.50 wt % Al, 0.60 wt % Mn, b2=2.50 wt % Al, 0.60 wt % Mn, b4=2.50 wt % Al, 0.40 wt % Mn, and b5=1.50 wt % Al, 0.40 wt % Mn).

In some example embodiments, to obtain an optimum balance between ductility and strength, a fourth composition range may have the following coordinate points in the Al—Mn diagram in FIG. 6: c1-c2-c3-c4-c1 (where c1=1.75 wt % Al, 0.55 wt % Mn, c2=2.25 wt % Al, 0.55 wt % Mn, c3=1.75 wt % Al, 0.45 wt % Mn, and c4=2.25 wt % Al, 0.55 wt % Mn).

In some example embodiments, inclusion of Zn in the magnesium alloy may allow for a wider range of processing conditions to produce acceptable forged components. In some example embodiments, exclusion of Zn in the magnesium alloy may allow for processing conditions to produce acceptable forged components.

In certain example embodiments, the magnesium alloy further comprises zinc (Zn) at a concentration of greater than or equal to about 0.0 wt. % to less than or equal to about 3.0 wt. % and subranges thereof. In certain aspects, the zinc is present at greater than or equal to about 0.01 wt. % to less than or equal to about 3.0 wt. %, optionally greater than or equal to about 0 or 0.01 wt. % to less than or equal to about 1.5 wt. %, and in certain variations, optionally greater than or equal to about 0.5 wt. % to less than or equal to about 1 wt. %. In certain example embodiments, the magnesium alloy comprises zinc at a concentration of about 0.01 wt. %, about 0.1 wt. %, about 0.2 wt. %, about 0.4 wt. %, about 0.6 wt. %, about 0.8 wt. %, about 1.0 wt. %, about 1.2 wt. %, about 1.4 wt. %, about 1.6 wt. %, about 1.8 wt. %, about 2.0 wt. %, about 2.2 wt. %, about 2.4 wt. %, about 2.6 wt. %, about 2.8 wt. %, and/or about 3 wt. %. In some example embodiments, the magnesium alloy is substantially free of zinc. As used herein, "substantially free" refers to trace component levels, such as levels of less than or equal to about 0.0001 wt. % or levels that are not detectable.

Figure 7A:
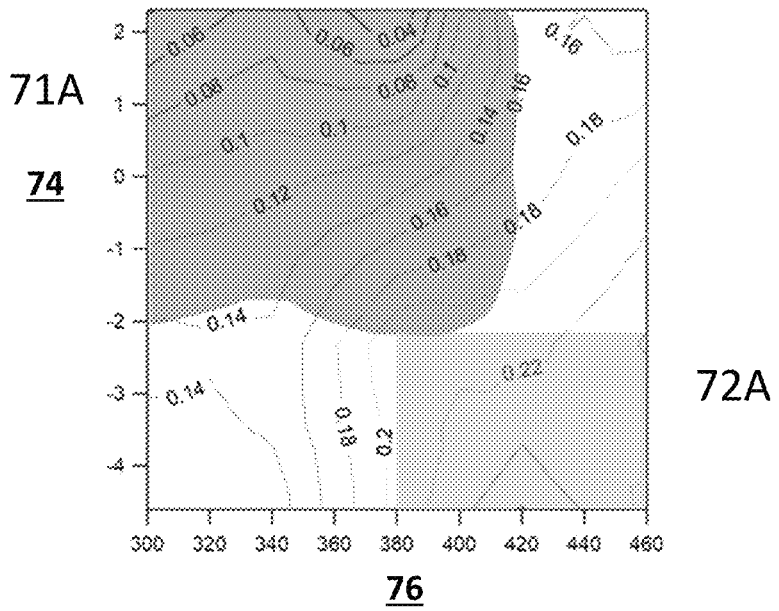
FIGS. 7A and 7B illustrate processing maps of a true strain at 0.9 for magnesium alloys according to some example embodiments.
Figure 7B:
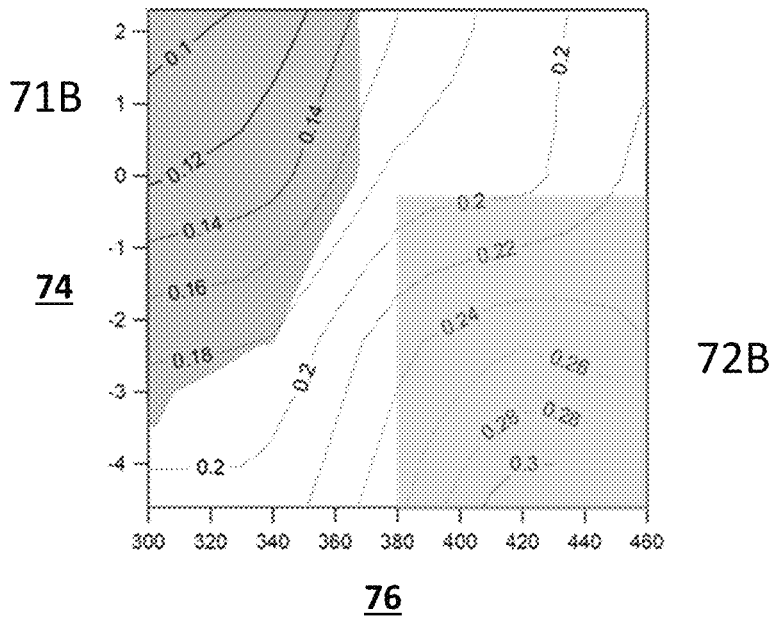

FIGS. 7A and 7B illustrate processing maps of a true strain at 0.9 for magnesium alloys of some example embodiments. The y-axis 74 is ln $\dot{\varepsilon}$ and x-axis 76 is temperature in ° C. FIG. 7A shows a processing map for a magnesium alloy having about 2.0 wt. % Al and about 0.5 wt. % Mn. FIG. 7B shows a processing map for a magnesium alloy having about 2.0 wt. % Al, about 0.5 wt. % Mn, and about 1.0 wt. % Zn.

Each processing map includes an efficiency of power dissipation along the contours. A higher efficiency of power dissipation improves the workability of the metal. The darker gray shading correspond to flow instability regions 71A and 71B. The flow instability regions 71A and 71B correspond to processing conditions that may fracture or overly deform the magnesium alloy during forging. The lighter gray shading corresponds to working domains 72A and 72B. The working domains 72A and 72B represent processing conditions that correspond with efficient forging which produce acceptable forged components. It is shown that Zn addition is beneficial for a wider range of processing conditions.

As described further below, other alloying components may be present in the magnesium alloy composition. Further, the alloy may comprise a cumulative amount of impurities and contaminants at less than or equal to about 0.3 wt. % of the total alloy composition, optionally less than or equal to about 0.1 wt. %, and in certain variations, less than or equal to about 0.05 wt. %.

The magnesium makes up the balance of the magnesium alloy, and in certain example embodiments may be greater than or equal to about 85 wt. %.

In certain example embodiments, the magnesium alloy further comprises tin (Sn) at a concentration of greater than or equal to about 0.0 wt. % to less than or equal to about 3.0 wt. % and subranges thereof. Sn addition may be beneficial for strength as it may promote aging-induced precipitation strengthening. In certain aspects, the tin is present at greater than or equal to about 0.01 wt. % to less than or equal to about 3.0 wt. %, optionally greater than or equal to about 0 or 0.01 wt. % to less than or equal to about 1.5 wt. %, and in certain variations, optionally greater than or equal to about 0.5 wt. % to less than or equal to about 1 wt. %. In certain example embodiments, the magnesium alloy comprises tin at a concentration of about 0.01 wt. %, about 0.1 wt. %, about 0.2 wt. %, about 0.4 wt. %, about 0.6 wt. %, about 0.8 wt. %, about 1.0 wt. %, about 1.2 wt. %, about 1.4 wt. %, about 1.6 wt. %, about 1.8 wt. %, about 2.0 wt. %, about 2.2 wt. %, about 2.4 wt. %, about 2.6 wt. %, about 2.8 wt. %, and/or about 3 wt. %. In some example embodiments, the magnesium alloy is substantially free of zinc. As used herein, "substantially free" refers to trace component levels, such as levels of less than or equal to about 0.0001 wt. % or levels that are not detectable.

In certain example embodiments, the magnesium alloy further comprises calcium (Ca) at a concentration of greater than or equal to about 0.0 wt. % to less than or equal to about 0.5 wt. % and subranges thereof. Ca addition may be beneficial for heat-resistance and corrosion resistance of the magnesium alloy. In certain aspects, the calcium is present at greater than or equal to about 0.01 wt. % to less than or equal to about 0.5 wt. %, optionally greater than or equal to about 0 wt. % to less than or equal to about 0.2 wt. %, and in certain variations, optionally greater than or equal to about 0.01 wt. % to less than or equal to about 0.2 wt. %. In certain example embodiments, the magnesium alloy comprises calcium at a concentration of about 0.01 wt. %, about 0.1 wt. %, about 0.2 wt. %, about 0.3 wt. %, about 0.4 wt. %, and/or about 0.6 wt. %. In some example embodiments, the magnesium alloy is substantially free of calcium. As used herein, "substantially free" refers to trace component levels, such as levels of less than or equal to about 0.0001 wt. % or levels that are not detectable.

In certain example embodiments, the magnesium alloy further comprises rare earth metals at a concentration of greater than or equal to about 0 wt. % to less than or equal to about 5 wt. % and subranges thereof. Rare earth metals may be beneficial for strength. In certain aspects, the rare earth metals are present at greater than or equal to about 0.01 wt. % to less than or equal to about 5 wt. %, optionally greater than or equal to about 0 wt. % to less than or equal to about 1.5 wt. %, and in certain variations, optionally greater than or equal to about 0.5 wt. % to less than or equal to about 1 wt. %. In certain example embodiments, the magnesium alloy comprises rare earth metals at a concentration of about 0 wt. %, about 0.5 wt. %, about 1 wt. %, about 1.5 wt. %, about 2 wt. %, about 2.5 wt. %, about 3 wt. %, about 3.5 wt. %, about 4 wt. %, about 4.5 wt. %, and/or about 5 wt. %. In some example embodiments, the magnesium alloy is substantially free of rare earth metals. As used herein, "substantially free" refers to trace component levels, such as levels of less than or equal to about 0.0001 wt. % or levels that are not detectable.

In certain example embodiments, the magnesium alloy may further comprises trace amounts of iron (Fe) as an impurity, for example, about 20 parts per million. In some example embodiments, the magnesium alloy is substantially free of iron. As used herein, "substantially free" refers to trace component levels, such as levels of less than or equal to about 0.0001 wt. % or levels that are not detectable.

The magnesium alloy can include certain combinations of Al, Mn, Zn, Sn, Ca, rare earth metals, and Fe at their respective concentrations described above. In some example embodiments, the magnesium alloy consists essentially of Al, Mn, and Mg. As described above, the term "consists essentially of" means the magnesium alloy excludes additional compositions, materials, components, elements, and/or features that materially affect the basic and novel characteristics of the magnesium alloy, such as the magnesium alloy not requiring extrusion before being formed into a press-hardened magnesium component, but any compositions, materials, components, elements, and/or features that do not materially affect the basic and novel characteristics of the magnesium alloy can be included in the example embodiment. Therefore, when the magnesium alloy consists essentially of Al, Mn, and Mg, the magnesium alloy can also include any combination of Zn, Sn, Ca, and rare earth metals, as provided above, that does not materially affect the basic and novel characteristics of the magnesium alloy. In other example embodiments, the magnesium alloy consists of Al, Mn, and Mg at their respective concentrations described above and at least one of Zn, Sn, Ca, and rare earth metals at their respective concentrations described above. Other elements that are not described herein can also be included in trace amounts, i.e., amounts of less than or equal to about 1.5 wt. %, less than or equal to about 1 wt. %, less than or equal to about 0.5 wt. %, or amounts that are not detectable, provided that they do not materially affect the basic and novel characteristics of the magnesium alloy.

In some example embodiments, the magnesium alloy consists essentially of Al, Mn, and Mg. In some example embodiments, the magnesium alloy consists of Al, Mn, and Mg.

In some example embodiments, the magnesium alloy consists essentially of Al, Mn, Zn, and Mg. In some example embodiments, the magnesium alloy consists of Al, Mn, Zn, and Mg.

In some example embodiments, the magnesium alloy consists essentially of Al, Mn, Sn, and Mg. In some example embodiments, the magnesium alloy consists of Al, Mn, Sn, and Mg.

In some example embodiments, the magnesium alloy consists essentially of Al, Mn, Ca, and Mg. In some example embodiments, the magnesium alloy consists of Al, Mn, Ca, and Mg.

In some example embodiments, the magnesium alloy consists essentially of Al, Mn, rare earth metals, and Mg. In some example embodiments, the magnesium alloy consists of Al, Mn, rare earth metals, and Mg.

In some example embodiments, the magnesium alloy consists essentially of Al, Mn, Zn, Sn and Mg. In some example embodiments, the magnesium alloy consists of Al, Mn, Zn, Sn, and Mg.

In some example embodiments, the magnesium alloy consists essentially of Al, Mn, Zn, Sn, Ca, and Mg. In some example embodiments, the magnesium alloy consists of Al, Mn, Zn, Sn, Ca, and Mg.

In some example embodiments, the magnesium alloy consists essentially of Al, Mn, Zn, Sn, rare earth metals, and Mg. In some example embodiments, the magnesium alloy consists of Al, Mn, Zn, Sn, rare earth metals, and Mg.

In some example embodiments, the magnesium alloy consists essentially of Al, Mn, Zn, Sn, Ca, rare earth metals, and Mg. In some example embodiments, the magnesium alloy consists of Al, Mn, Zn, Sn, Ca, rare earth metals, and Mg.

In some example embodiments, the magnesium alloy consists essentially of Al, Mn, Zn, Ca, and Mg. In some example embodiments, the magnesium alloy consists of Al, Mn, Zn, Ca, and Mg.

In some example embodiments, the magnesium alloy consists essentially of Al, Mn, Zn, Ca, rare earth metals, and Mg. In some example embodiments, the magnesium alloy consists of Al, Mn, Zn, Ca, rare earth metals, and Mg.

In some example embodiments, the magnesium alloy consists essentially of Al, Mn, Zn, rare earth metals, and Mg. In some example embodiments, the magnesium alloy consists of Al, Mn, Zn, rare earth metals, and Mg.

In some example embodiments, the magnesium alloy consists essentially of Al, Mn, Sn, Ca, and Mg. In some example embodiments, the magnesium alloy consists of Al, Mn, Sn, Ca, and Mg.

In some example embodiments, the magnesium alloy consists essentially of Al, Mn, Sn, Ca, rare earth metals, and Mg. In some example embodiments, the magnesium alloy consists of Al, Mn, Sn, Ca, rare earth metals, and Mg.

In some example embodiments, the magnesium alloy consists essentially of Al, Mn, Sn, rare earth metals, and Mg. In some example embodiments, the magnesium alloy consists of Al, Mn, Sn, rare earth metals, and Mg.

In some example embodiments, the magnesium alloy consists essentially of Al, Mn, Ca, rare earth metals, and Mg. In some example embodiments, the magnesium alloy consists of Al, Mn, Ca, rare earth metals, and Mg.

Table 1 shows a composition of an example embodiment of the magnesium alloy.

TABLE 1

Composition of magnesium alloy according to example embodiments.

| | Chemical Composition (wt. %) | | | |
|---|---|---|---|---|
| Composition | Al | Mn | Others | Mg |
| Range | 0.5-2.5 | 0.3-1* | Zn < 3, Sn < 3, Ca < 0.5, Rare earth metals < 5 | Balance |

*A minimum manganese (Mn) concentration being greater than or equal to about 0.3 wt. % based on the aluminum (Al) concentration being about 0.5 wt. % and increasing linearly to being greater than or equal to about 0.35 wt. % based on the aluminum (Al) concentration being about 2.5 wt. %

Such magnesium alloys have the capability of forming thermally stable dispersoids of intermetallic species during pre-deformation heat treatment. In some example embodiments, the intermetallic species may have a composition of Al—Mn. The thermally stable dispersoids are located within and throughout grains that are distributed in a matrix of the magnesium-based alloy and can remain stable during higher temperature processing, for example, at temperatures of greater than or equal to about 500° C. Thermally stable refined dispersoids can pin dislocations and retard dynamic recrystallization (DRX) during any intermediate treating or processing steps that are contemplated herein. Thus, the microstructures formed during certain methods of treatment provided by the present disclosure form domains that ultimately are resistant to dynamic recrystallization (or alternatively static recrystallization). These domains are thus rich in thermally stable dispersoids and after undergoing high strain processing, are embedded in a matrix of dynamically recrystallized grains or domains that are lean in the thermally stable precipitates.

In certain variations, the present disclosure provides a method of treating a casting (e.g., billet, slab, cast-to-size article, and the like) formed of a magnesium-based alloy, like those described above, which include precipitates/intermetallic species. The treating includes a homogenization (or, alternatively, annealing) process. The homogenization process includes a heating process which may be conducted in an environment having a temperature of greater than or equal to about 360° C. to less than or equal to about 450° C., optionally greater than or equal to about 380° C. to less than or equal to about 420° C., and optionally about 400° C. The homogenization process may hold the casting in the temperature range longer than or equal to 4 hours to less than or equal to 10 hours, longer than or equal to 4 hours to less than or equal to 6 hours, about 4 hours, about 5 hours, about 6 hours, about 7 hours, about 8 hours, about 9 hours, or about 10 hours. By controlling temperature and heating time during the homogenization process, nano-scale Al—Mn dispersoids can be obtained in the magnesium-based alloy.

Figure 8:
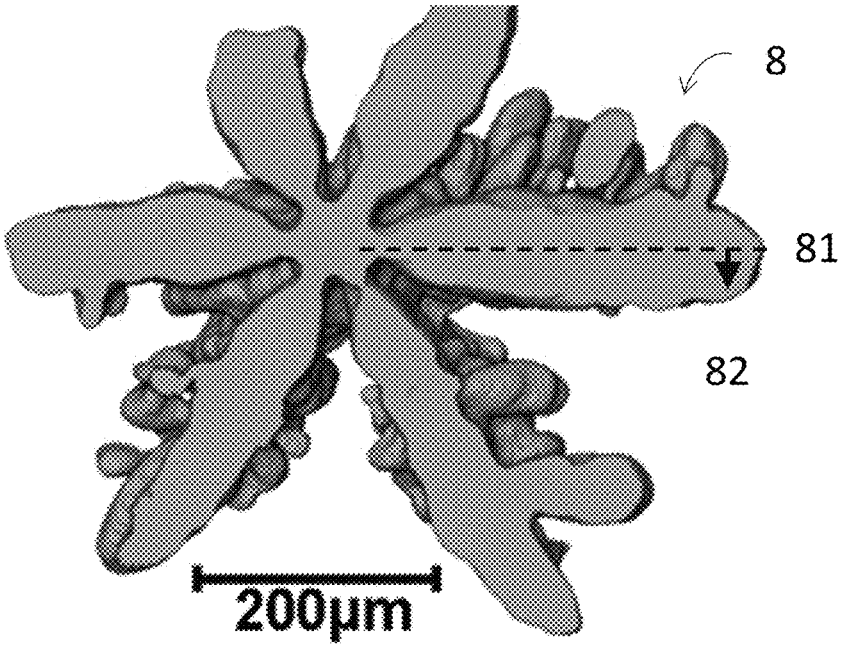
FIG. 8 illustrates a dendrite formation of magnesium alloy according to some example embodiments.

With reference to FIG. 8, in some example embodiments, as the magnesium alloy solidifies, the magnesium may solidify in a dendrite formation. In some example embodiments, the magnesium dendrite may resemble the magnesium dendrite 8. Each magnesium dendrite 8 in the alloy would have a dendrite core 81 and a dendrite edge 82. The magnesium dendrite 8 includes six dendrite formations, although there may be greater or fewer dendrite formations in each formation.

Figure 9:
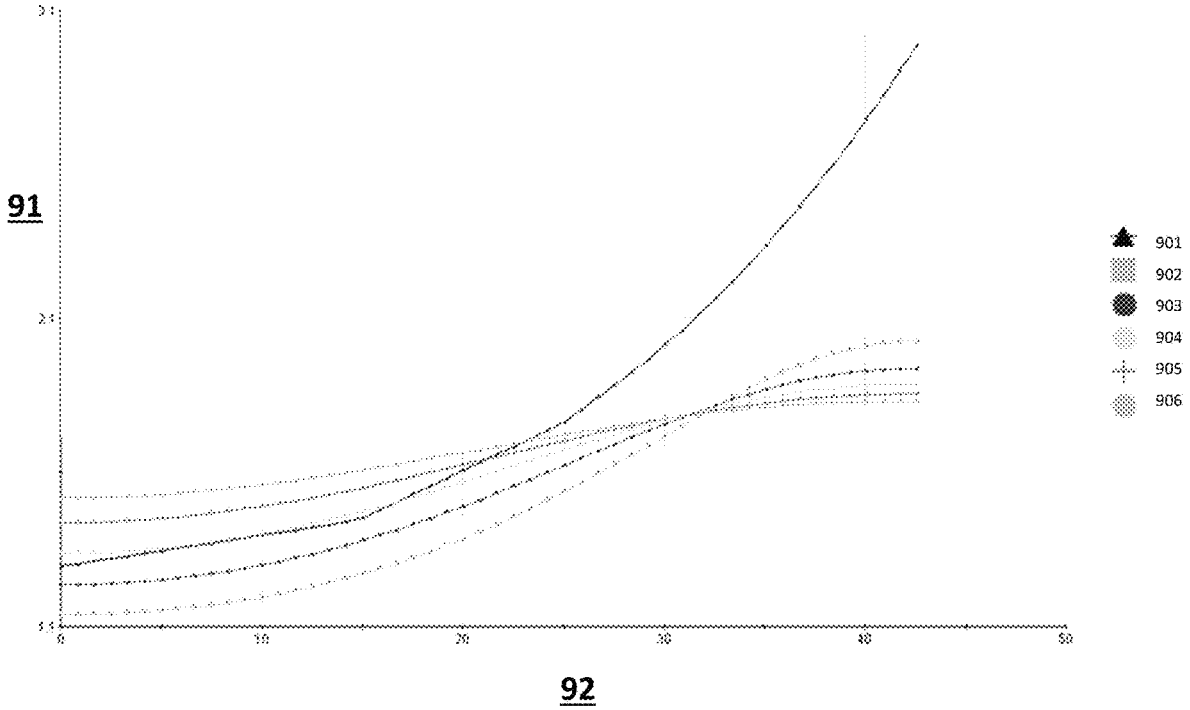
FIG. 9 illustrates a concentration of Al within a dendrite of magnesium alloy after homogenization processes at 360° C. according to some example embodiments.
Figure 10:
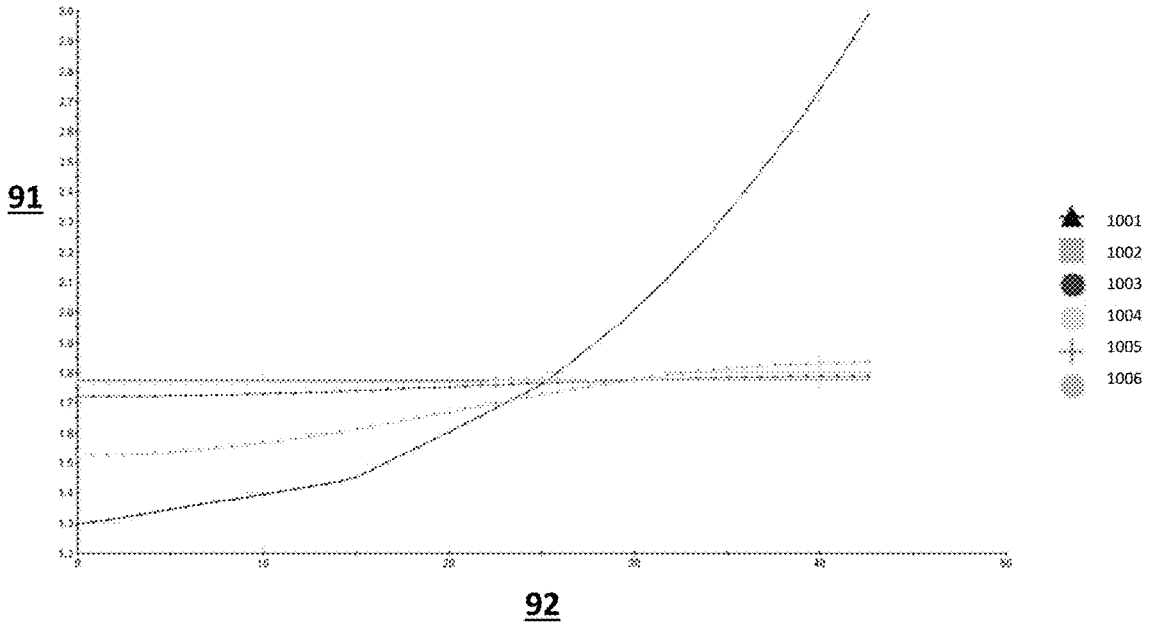
FIG. 10 illustrates a concentration of Al within a dendrite of magnesium alloy after homogenization processes at 400° C. according to some example embodiments.
Figure 11:
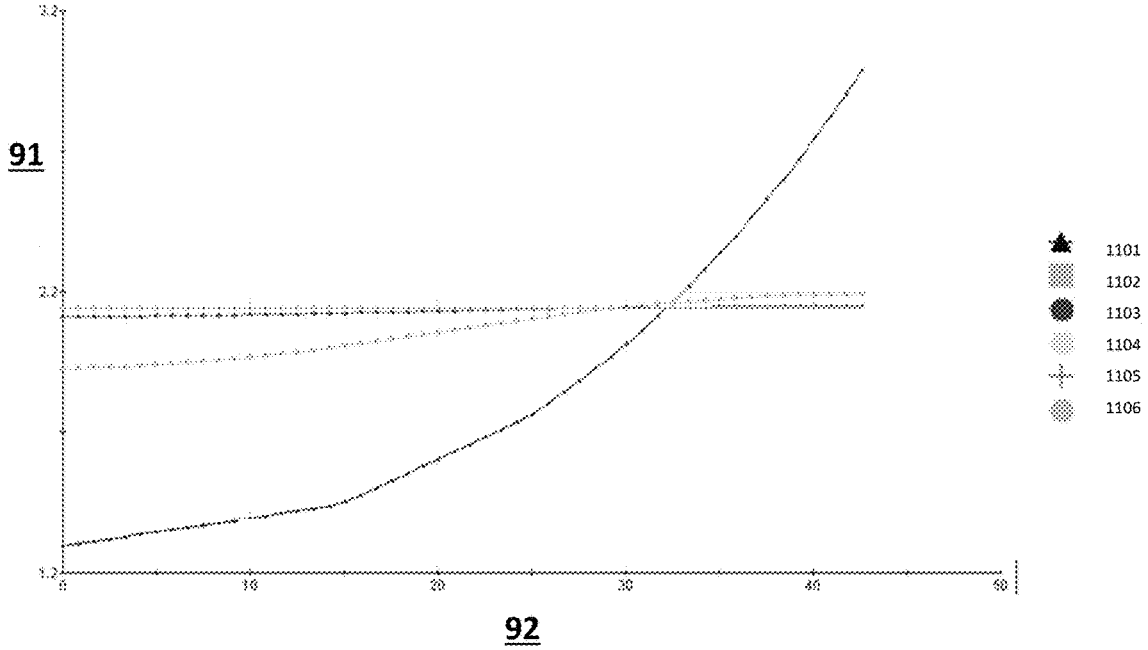
FIG. 11 illustrates a concentration of Al within a dendrite of magnesium alloy after homogenization processes at 450° C. according to some example embodiments.

The aluminum of the magnesium alloy may not be evenly distributed in the dendrite, with more aluminum at the dendrite edges at solidification. That is, there may be a higher concentration of aluminum at a dendrite edge 82 than at a dendrite core 81 at solidification. Homogenization treatment is traditionally applied to make the distribution of aluminum evenly in the dendrite. As shown in FIGS. 9-11, the homogenization process may alter the relative concentration of Al between the dendrite core and the dendrite edge.

As discussed above, homogenization can also precipitate Al—Mn dispersoids 21 in the present disclosure, due to the supersaturation of Mn in the dendrite. The longer homogenization treatment and higher homogenization treatment lead to coarser Al—Mn dispersoid, which is undesirable for high strength requirement. Temperature has a more significant impact than duration.

With reference to FIG. 9, a graph illustrates the concentration of Al wt. % (y-axis 91) at a distance from a dendrite core (x-axis 92) in microns as cast, or after a heat treatment of 360° C. for different time periods.

The concentration of Al wt. % from the dendrite core is shown in an as-cast sample in line 901, and after a heat treatment of 5 hours in line 902, of 10 hours in line 903, of 15 hours in line 904, of 19 hours in line 905, and of 24 hours in line 906.

The as cast concentration of Al is shown at about 1.2% at the dendrite core 81, gradually increasing to about 3% at the dendrite edge 82. In the 360° C. heat treatments, the Al concentration is a sigmoid curve, increasing concentration towards the dendrite edge 82. Further, longer treatment times show a more evenly distributed Al concentration at 360° C.

With reference to FIG. 10, a graph illustrates the concentration of Al at a distance from a dendrite core as cast, or after a heat treatment of 400° C. for different time periods.

The concentration of Al wt. % from the dendrite core is shown in an as-cast sample in line 1001, and after a heat treatment of 5 hours in line 1002, of 10 hours in line 1003, of 15 hours in line 1004, of 19 hours in line 1005, and of 24 hours in line 1006.

In the 400° C. heat treatments, the Al concentration is linear, with the 5-hour treatment showing a small increase from the dendrite core 81 to the dendrite edge 82, and the longer heat treatments showing relatively equal Al concentration from the dendrite core 81 to the dendrite edge 82.

With reference to FIG. 11, a graph illustrates the concentration of Al at a distance from a dendrite core as cast, or after a heat treatment of 450° C. for different time periods.

The concentration of Al wt. % from the dendrite core is shown in an as-cast sample in line 1101, and after a heat treatment of 1 hour in line 1102, of 2 hours in line 1103, of 3 hours in line 1104, of 4 hours in line 1105, and of 5 hours in line 1106.

In the 450° C. heat treatments, the Al concentrations are similar to the 400° C. heat treatments; however, the timer periods are much shorter. The Al concentrations are linear, with the 1-hour treatment showing a small increase from the dendrite core 81 to the dendrite edge 82, and the longer heat treatments showing relatively equal Al concentration from the dendrite core 81 to the dendrite edge 82.

In some example embodiments, based in part on FIGS. 9-11, to achieve a homogenized Al concentration in the magnesium dendrite 8, a heat treatment of greater than or equal to about 360° C. to less than or equal to about 450° C., for greater than or equal to about 1 hour to less than or equal to about 24 hours, or less than or equal to about 10 hours; greater than or equal to about 400° C. to less than or equal to about 450° C., for greater than or equal to about 1 hour to less than or equal to about 24 hours, or less than or equal to about 10 hours; greater than or equal to about 380° C. to less than or equal to about 420° C., for greater than or equal to about 1 hour to less than or equal to about 24 hours, or less than or equal to about 10 hours; greater than or equal to about 360° C. to less than or equal to about 420° C., for greater than or equal to about 4 hour to less than or equal to about 10 hours.

Figure 12:
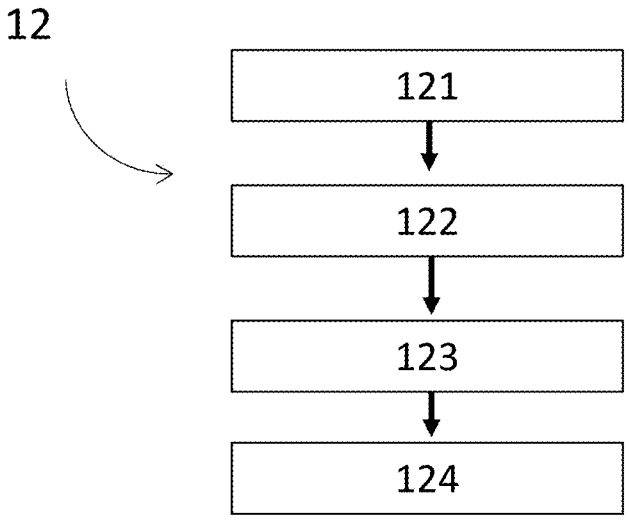
FIG. 12 illustrates a flowchart illustrating the forming of a magnesium alloy according to some example embodiments.

With reference to FIG. 12, the current technology also provides a method 12 of fabricating a magnesium alloy component, which may be used in an automobile. More particularly, the method includes forging the magnesium alloy described above to form the magnesium alloy component. The magnesium alloy may be processed without an extrusion process. The magnesium alloy component can be any component that is generally made by forging, such as, a vehicle part, for example. Non-limiting examples of vehicles that have parts suitable to be produced by the current method include bicycles, automobiles, motorcycles, boats, tractors, buses, mobile homes, campers, gliders, airplanes, and tanks. In certain example embodiments, the magnesium alloy component is an automobile part selected from the group consisting of a wheel, a pillar, a bumper, a roof rail, a rocker rail, a rocker, a control arm, a beam, a tunnel, a beam, a step, a subframe member, and a reinforcement panel.

More particularly, in some example embodiments, the method 12 includes an operation 121 for forming a magnesium alloy cast billet (alternatively, forming a slab, cast-to-size article, and the like). Operation 121 may include smelting a magnesium alloy according to the above composition. Operation 122 may include casting the smelted magnesium alloy, for example, direct chill casting a billet. Operation 123 may include a homogenization process including a heat treatment as disclosed above, for example at great than or equal to about 380° C. to less than or equal to about 420° C., for longer than or equal to about 4 hours to fewer than or equal to about 10 hours. Operation 124 may include forging the cast magnesium alloy to create a magnesium alloy component. The forging may include a single- or multi-step forging at elevated temperatures, for example about 300° C. to less than or equal to about 450° C., although the disclosure is not limited thereto and other forging methods may be used. Operation 124 may not include an extrusion step prior to forging.

EXAMPLES

A magnesium alloy ingot with a composition of, by weight, 2.0% aluminum, 0.57% manganese, 0.5% magnesium, 0.002% iron, and the balance magnesium was prepared in a semi-continuous casting production line in plant. The obtained ingot was about 1800 mm in length and 310 mm in diameter.

Figure 13:
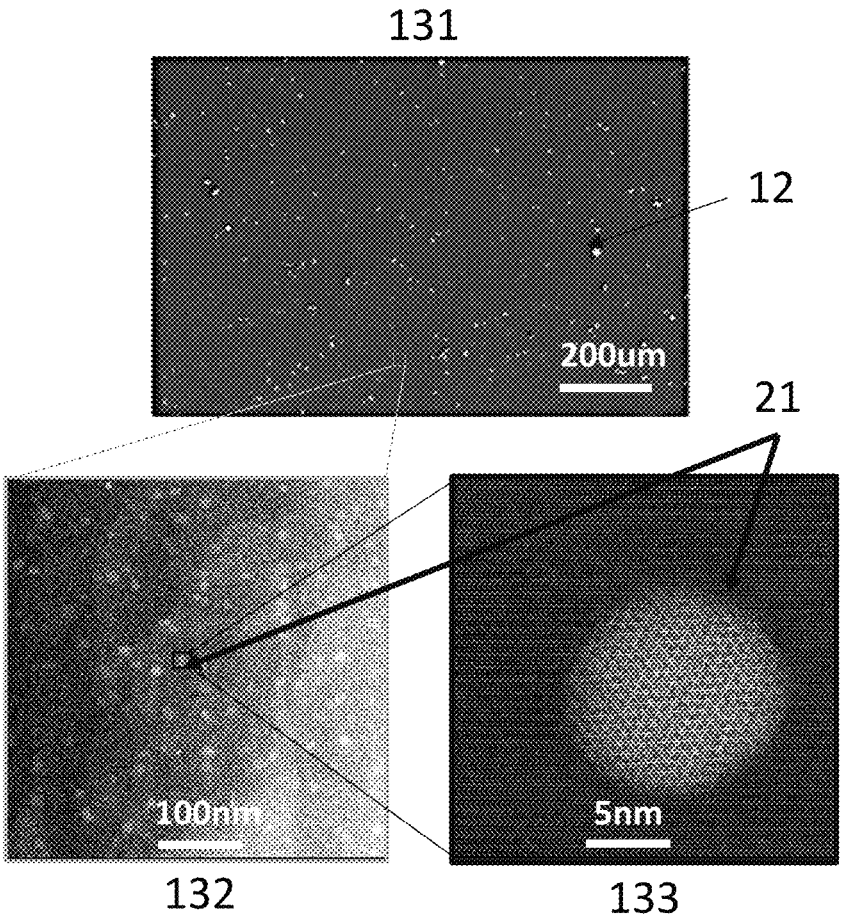
FIG. 13 illustrates electron microscopy of a portion of a magnesium alloy after homogenization according to some example embodiments.

As shown in the scanning electron microscopy (SEM) image 131 in FIG. 13 of a magnesium alloy as described above, after the homogenization process of maintaining 400° C. for 5 hours, the magnesium alloy includes a plurality of Mn containing intermetallics 12, which were formed in casting process. The Mn containing intermetallics 12 have an average diameter of about 10 μm. The Mn containing intermetallics 12 in magnesium alloys prepared in the above manner may be between about 1 μm and about 30 μm. The scanning transmission electron microscopy (STEM) image 132 shows a closer look at the magnesium alloy, and includes Al—Mn dispersoids 21 formed in homogenization process. The STEM image 133 shows a closer look at one of the Al—Mn dispersoids 21. The Al—Mn dispersoids 21 have an average diameter of about 10 nm. The Al—Mn dispersoids 21 in magnesium alloys prepared in the above manner may be between about 1 nm and about 50 nm. The Al—Mn dispersoids 21 have a spherical shape, although the Al—Mn dispersoids 21 may have other shapes. The Al—Mn dispersoids 21 may be $Al_8Mn_5$.

Figure 14:
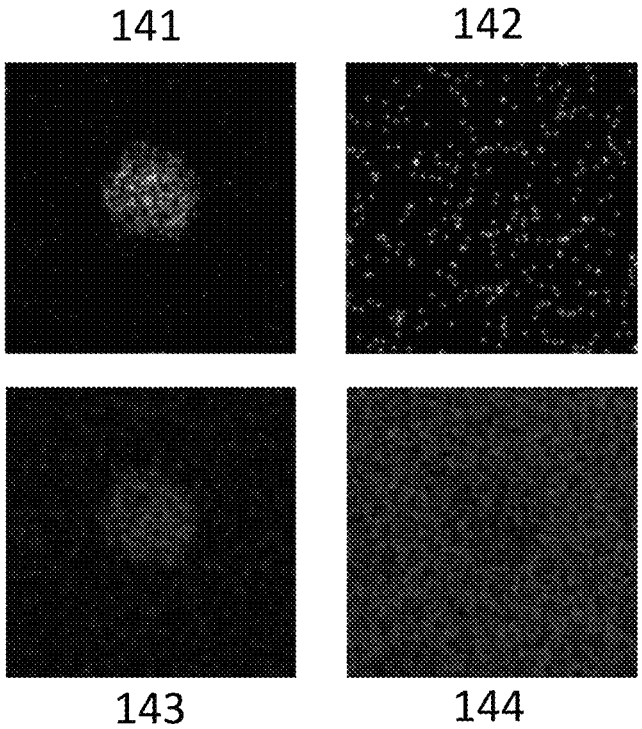
FIG. 14 illustrates energy dispersive x-ray spectroscopy maps of a magnesium alloy after homogenization according to some example embodiments.

With reference to FIG. 14, images 141, 142, 143, and 144 show the dispersion of Al, Zn, Mn, and Mg in the STEM image 133 showing the Al—Mn dispersoid 21.

The Al—Mn dispersoids 21 may contribute to precipitation strengthening and help refine dynamic recrystallized grains 31 that occur during forging by pinning on grain boundaries, which may contribute to grain boundary strengthening. In addition, Al—Mn dispersoid may contribute to enhanced non-basal slip activities, improving formability of as-homogenized billet.

Figure 15:
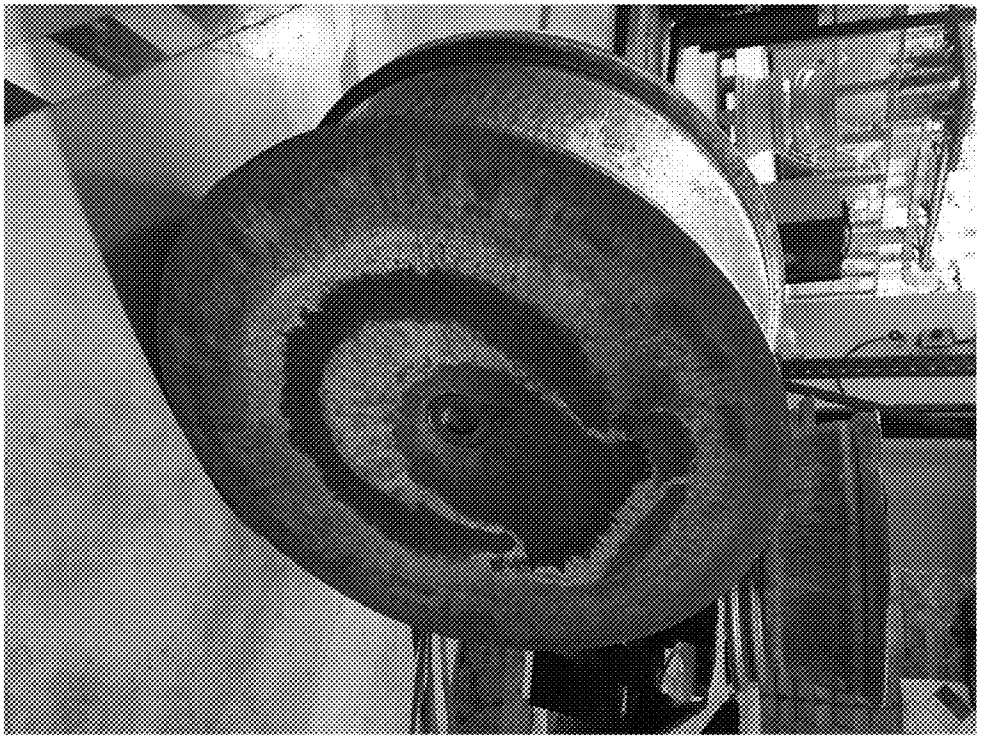
FIG. 15 illustrates a forged magnesium alloy according to some example embodiments.

FIG. 15 shows an intact forged component from billet according to some example embodiments, which has undergone a homogenization process at 400° C. for 5 hours without pre-extrusion. As such, Mg—Al—Mn—Zn alloys consistent with example embodiments of the present invention may have excellent formability, without pre-extrusion, and are capable of being forged directly.

Figure 16A:
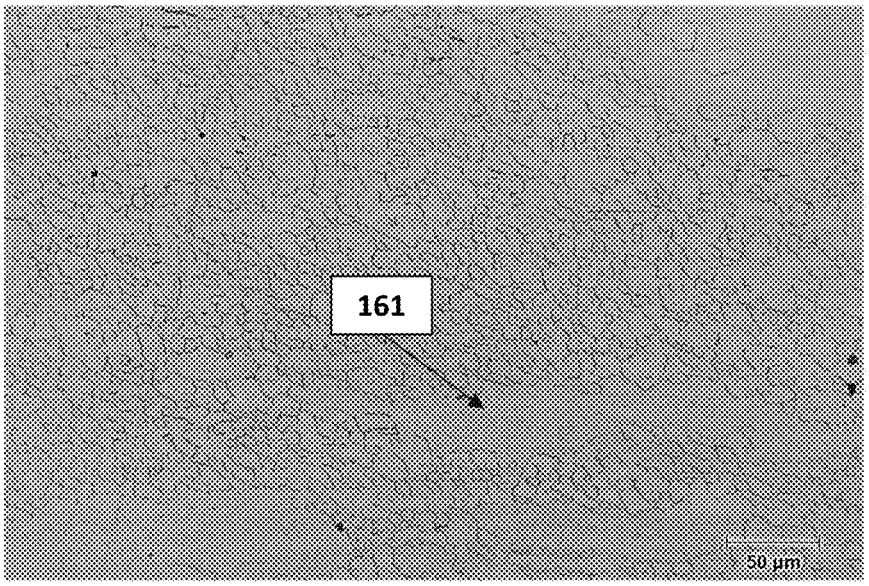
FIGS. 16A and 16B illustrate a microstructure of magnesium alloy after homogenization and forging according to some example embodiments.
Figure 16B:
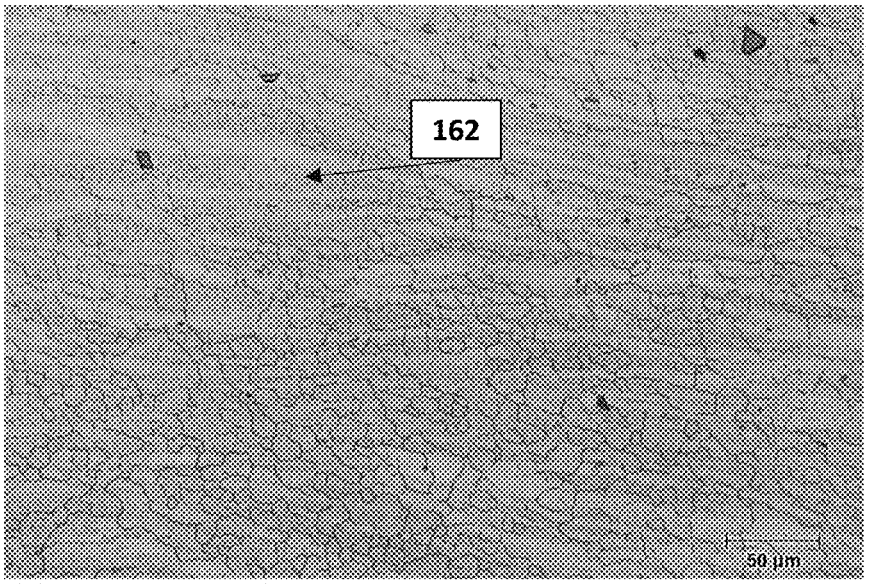

With reference to FIGS. 16A and 16B, microstructures of forged magnesium alloys consistent with example embodiments of the present invention have been examined FIG. 16A shows the forged magnesium alloy having undergone a homogenization process at 400° C. for 5 hours, and FIG. 16B shows the forged magnesium alloy having undergone a homogenization process at 400° C. at 10 hours.

The 5-hour homogenization process resulted in an average grain size of about 8 μm of the dynamically recrystallized grains 161 after forging. In some example embodiments, the 10-hour homogenization process resulted in an average grain size of about 16 μm of the dynamically recrystallized grains 162 after forging. In other words, a longer homogenization process may result in larger dynamically recrystallized grains after forging, and thus may lead to inferior strength properties.

Figure 17:
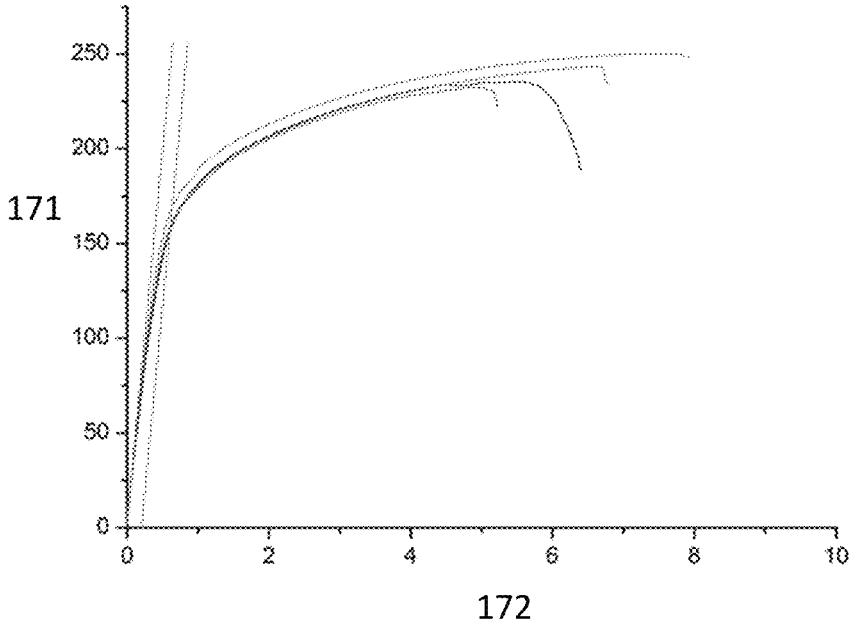
FIG. 17 illustrates a chart of stress vs. strain for a forged magnesium alloy component according to some example embodiments.

FIG. 17 illustrates a yield stress of a forged magnesium component prepared according to method 12 of some example embodiments. The stress (MPa) is shown on y-axis 171, and the strain (%) is shown on x-axis 172. The 0.2% proof strength of the forged magnesium component measured in five samples may be about 160 MPa.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A forged magnesium component comprising:

an alloy matrix comprising, aluminum (Al) at a concentration of greater than or equal to about 0.5 wt. % to less than or equal to about 2.5 wt. %, manganese (Mn) at a concentration of greater than or equal to about 0.3 wt. % to less than or equal to about 1.0 wt. %, the concentration of manganese is greater than or equal to a value of [Mn] determined by a linear function [Mn]=x[Al], where x has a value such that x is at least 0.6 when [Al]=0.5 and is at least 0.14 when [Al]=2.5, zinc (Zn) at a concentration of greater than or equal to about 0 wt. % to less than or equal to about 3 wt. %, tin (Sn) at a concentration of greater than or equal to about 0 wt. % to less than or equal to about 3 wt. %, calcium (Ca) at a concentration of greater than or equal to about 0 wt. % to less than 0.175 wt. %, rare earth metals at a concentration of greater than or equal to about 0 wt. % to less than or equal to about 5 wt. %, the rare earth metals being one or more of an element of the lanthanide series, scandium (Sc), Yttrium (Y), or a combination thereof, and a balance of the alloy composition being magnesium (Mg);

the alloy matrix including a microstructure including partially dynamically recrystallized grains, an average grain size of the dynamically recrystallized grains being less than or equal to 10 μm, and Al—Mn dispersoids dispersed in the microstructure.

2. The forged magnesium component of claim 1, wherein the aluminum (Al) is at a concentration of greater than or equal to about 1.5 wt. % to less than or equal to about 2.5 wt. %, the manganese (Mn) is at a concentration of greater than or equal to about 0.3 wt. % to less than or equal to about 0.6 wt. %.

3. The forged magnesium component of claim 1, wherein the aluminum (Al) is at a concentration of greater than or equal to about 1.75 wt. % to less than or equal to about 2.25 wt. %, the manganese (Mn) is at a concentration of greater than or equal to about 0.45 wt. % to less than or equal to about 0.55 wt. %.

4. The forged magnesium component of claim 3, wherein the zinc (Zn) is at a concentration of greater than or equal to about 0 wt. % to less than or equal to about 1.5 wt. %.

5. The forged magnesium component of claim 4, wherein the zinc (Zn) is at a concentration of greater than or equal to about 0.5 wt. % to less than or equal to about 1.0 wt. %, the calcium (Ca) is at a concentration of greater than or equal to about 0 wt. % to less than or equal to about 0.2%.

6. The forged magnesium component of claim 1, wherein the alloy composition includes at least 0.01 wt. % of at least one of the group consisting of the zinc (Zn), tin (Sn), calcium (Ca), and rare earth metals, or a combination thereof.

7. A forged magnesium component comprising:

an alloy matrix comprising, a concentration of Al [Al], a concentration of manganese greater than or equal to a value of [Mn] determined by a linear function [Mn]=x[Al], where x has a value such that x is at least 0.6 when [Al]=0.5 and is at least 0.14 when [Al]=2.5, Al—Mn dispersoids including $Al_8Mn_5$ dispersoids and Beta-Mn (Al) dispersoids, the Al—Mn dispersoids having an average diameter of greater than 1 nm and less than 100 nm, and the alloy matrix having a microstructure including partially dynamically recrystallized grains.

8. The forged magnesium component of claim 7, wherein the alloy composition includes aluminum (Al) at a concentration [Al] of greater than or equal to about 0.5 wt. % to less than or equal to about 2.5 wt. %;

manganese (Mn) at a concentration of greater than or equal to about 0.3 wt. % to less than or equal to about 1.0 wt. %, the concentration of manganese is greater than or equal to a value of [Mn] determined by a linear function [Mn]=x[Al], where x has a value such that x is at least 0.6 when [Al]=0.5 and is at least 0.14 when [Al]=2.5;

zinc (Zn) at a concentration of greater than or equal to about 0 wt. % to less than or equal to about 3 wt. %;

tin (Sn) at a concentration of greater than or equal to about 0 wt. % to less than or equal to about 3 wt. %;

calcium (Ca) at a concentration of greater than or equal to about 0 wt. % to less than or equal to about 0.5%;

rare earth metals at a concentration of greater than or equal to about 0 wt. % to less than or equal to about 5 wt. %, the rare earth metals being one or more of an element of the lanthanide series, scandium (Sc), Yttrium (Y), or a combination thereof; and a balance of the alloy composition being magnesium (Mg).

9. The forged magnesium component of claim 8, wherein the alloy composition includes at least 0.01 wt. % of at least one of the group consisting of the zinc (Zn), tin (Sn), calcium (Ca), and rare earth metals, or a combination thereof.

10. The forged magnesium component of claim 7, wherein the Al—Mn dispersoids having an average diameter less than about 100 nm.

* * * * *